US005094350A

United States Patent [19]

Smock

[11] Patent Number: 5,094,350

[45] Date of Patent: Mar. 10, 1992

[54] FLOW RACK ARRANGEMENT

[75] Inventor: William L. Smock, Indianapolis, Ind.

[73] Assignee: Smock Material Handling Company, Inc., Indianapolis, Ind.

[21] Appl. No.: 700,564

[22] Filed: May 15, 1991

[51] Int. Cl.[5] ..... A47F 5/00

[52] U.S. Cl. ..... 211/59.2; 211/150; 211/187; 248/242; 248/243

[58] Field of Search ..... 211/151, 59.2, 187, 211/150, 192; 108/111, 107; 248/241, 242, 243

[56] References Cited

U.S. PATENT DOCUMENTS

| | | | |
|---|---|---|---|
| 853,344 | 5/1907 | Dennis | 248/241 |
| 2,136,109 | 11/1938 | Kress | 248/242 X |
| 3,900,112 | 8/1975 | Azzi et al. | 211/187 |
| 4,405,052 | 9/1983 | Spiros | 211/187 X |
| 4,765,493 | 8/1988 | Kinney | 211/59.2 |
| 4,923,070 | 5/1990 | Jackle et al. | 211/59.2 |

*Primary Examiner*—Robert W. Gibson, Jr.
*Attorney, Agent, or Firm*—Flynn, Thiel, Boutell & Tanis

[57] ABSTRACT

An adjustable rack construction in which the shelf is supported so that its vertical position and angle of inclination with respect to the vertical can be changed by an operator without using any tools.

6 Claims, 3 Drawing Sheets

FLOW RACK ARRANGEMENT

FIELD OF THE INVENTION

This invention relates to an adjustable rack construction for the handling of materials and parts in manufacturing and assembly plants.

BACKGROUND OF THE INVENTION

Manufacturing and assembly plants utilize racks for the temporary storage of materials and parts in connection with various manufacturing and assembly operations. A conventional type of rack comprises a plurality of vertically spaced-apart, inclined shelves which are supported on upright posts. In a typical example of the use of such a rack, from time to time a supply worker places a supply of parts on the upper end portions of the shelves. The assembly operator removes parts from the lower ends of the shelves, as needed for the assembly operation. As parts are removed from the lower ends of the shelves, the parts on the higher portions of the shelves slide downwardly toward the lower ends thereof so as to be more easily accessible to the assembly operator. Such racks are commonly called "flow" racks and they will be referred to by that term in the following description.

Flow rack constructions usually are quite strong because they must be capable of supporting loads of several hundred pounds or more. Also, it is usually necessary to construct the flow racks so that both the vertical positions and the angles of inclination of the shelves, relative to the vertical, can be adjusted in order that the shelves can be properly arranged for convenient use by different operators who may have different preferences as regard the optimum positioning of the shelves. Prior flow racks have had relatively complex structures for mounting the shelves on the posts and it was necessary to use various kinds of tools in order to change the positions of the shelves. In many cases, the assembly operators could not perform the necessary procedures and it was necessary to obtain the assistance of a machine maintenance worker in order to adjust the positions of the shelves.

The present invention provides an improved flow rack in which the vertical heights and angles of inclination of the shelves can readily be adjusted by an assembly operator without requiring the use of tools or the assistance of a maintenance worker.

According to the invention, there is provided a flow rack comprising one or more shelves and upright posts for supporting the shelves. A pair of support structures are provided for supporting the shelves for pivotal movement and for back and forth sliding movement relative to the upright posts.

More particularly, the invention provides a flow rack having a plurality of horizontally elongated, vertically spaced-apart shelves which are supported at their opposite ends by a pair of upright post assemblies. A pair of support structures are associated with each shelf. The support structures are spaced from each other and are located close to the back and close to the front of the shelves, respectively. Each of the support structures comprises a support post which extends lengthwise of the shelf between the post assemblies. The support post is releasably fixedly secured to the upright post assemblies. Support members are fixedly secured to the shelf close to the opposite ends thereof. The support members have elongated openings therethrough which are elongated in a direction extending from the rear toward the front of the shelf. The support post extends through the openings in the support members at the ends of the support post. Thus, the shelf can move frontwardly and rearwardly and can pivot with respect to the support posts as a result of the presence of the elongated slot through which the support post extends.

DETAILED DESCRIPTION

Figure 1:
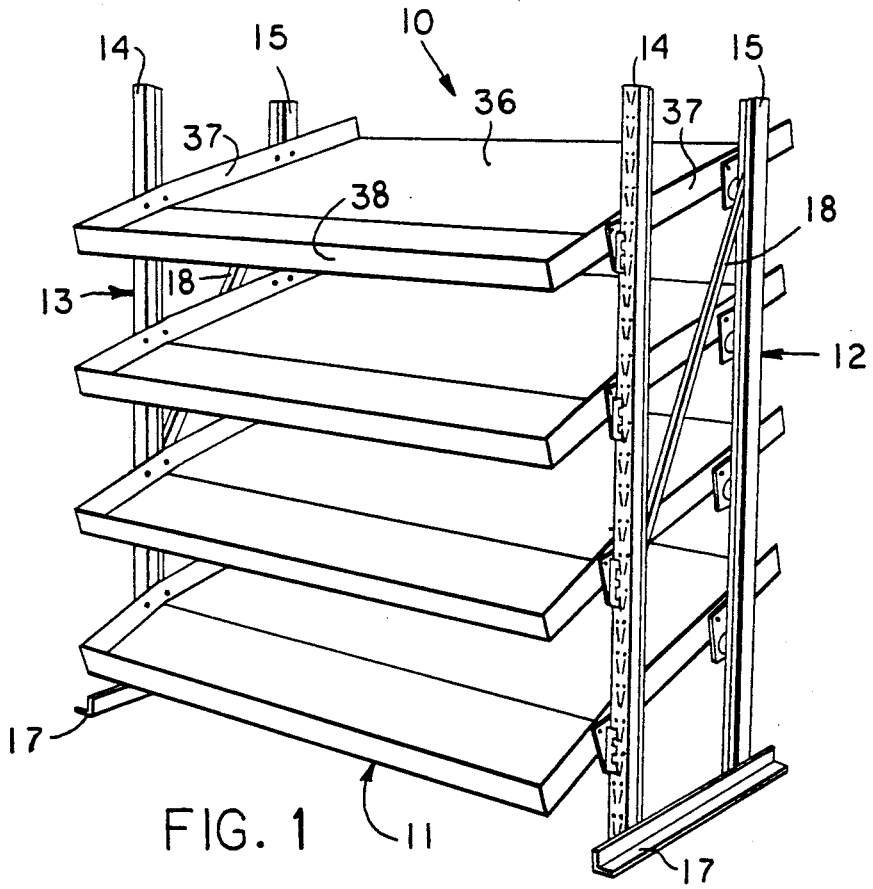
FIG. 1 is a perspective view of a flow rack according to this invention.

Referring to FIG. 1, there is illustrated a flow rack 10 which is comprised of a plurality of vertically spaced-apart, substantially horizontally extending, elongated shelves 11, which shelves may be inclined with respect to the vertical from front to back. The opposite longitudinal ends of the shelves 11 are supported by upright, rigid, post assemblies 12 and 13. The post assemblies 12 and 13 are each comprised of a pair of posts 14 and 15 which are connected together by floor-engaging braces 17 and by inclined cross braces 18.

The posts 14 and 15 are of known construction. In the illustrated embodiment, the posts 14 and 15 are identical to each other. Each of the posts 14 is positioned in mirror image, opposing relationship to its associated posts 15 of the post assemblies 12 and 13. Accordingly, only the post 14 of post assembly 12 will be described in detail herein. It will be understood that this description will also apply to the other posts.

Figure 3:
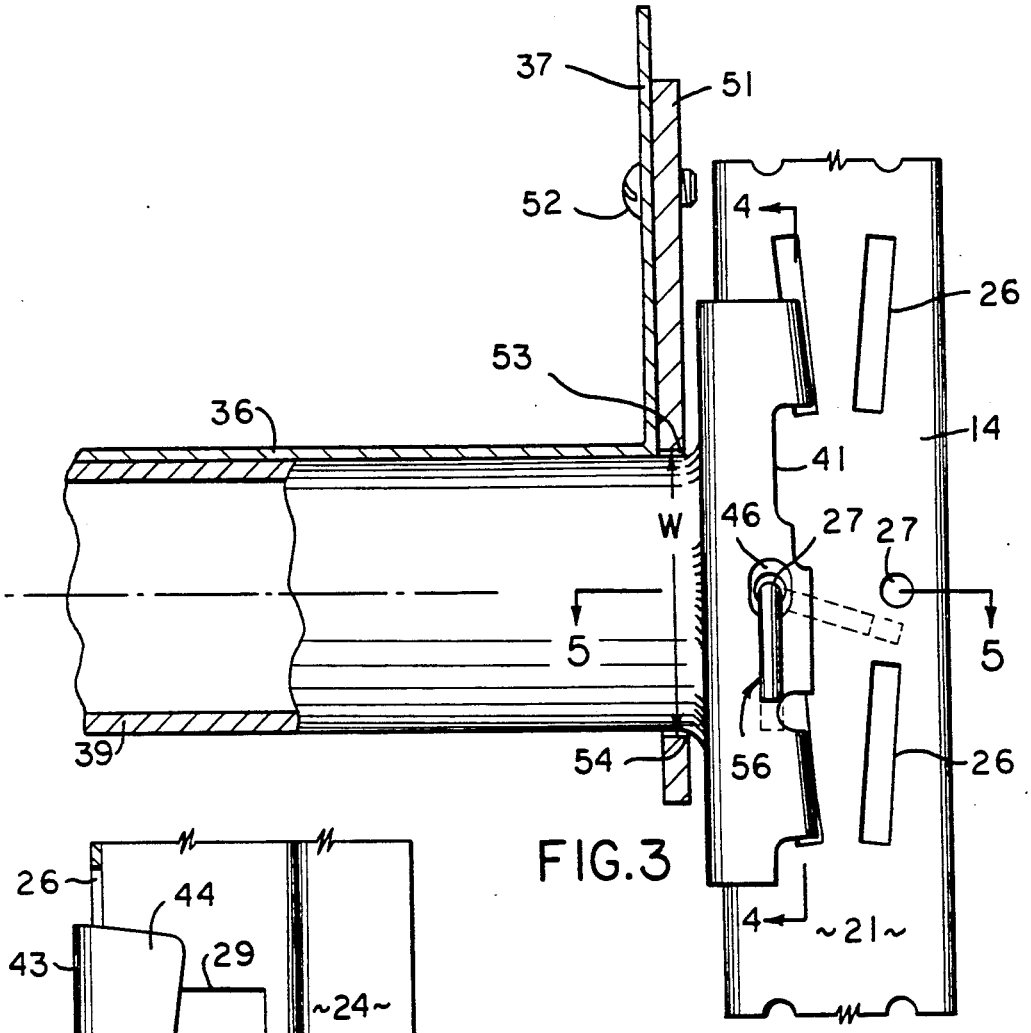
FIG. 3 is a sectional view taken substantially along the line 3—3 in FIG. 2.
Figure 4:
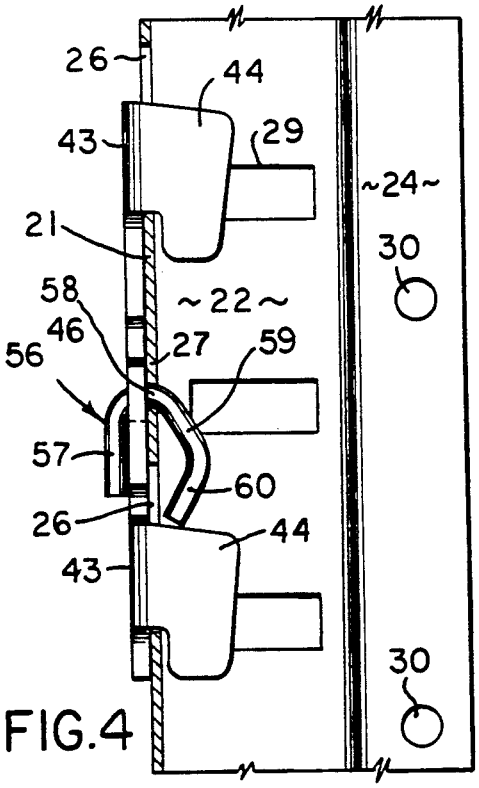
FIG. 4 is a sectional view taken substantially along the line 4—4 in FIG. 3.
Figure 5:
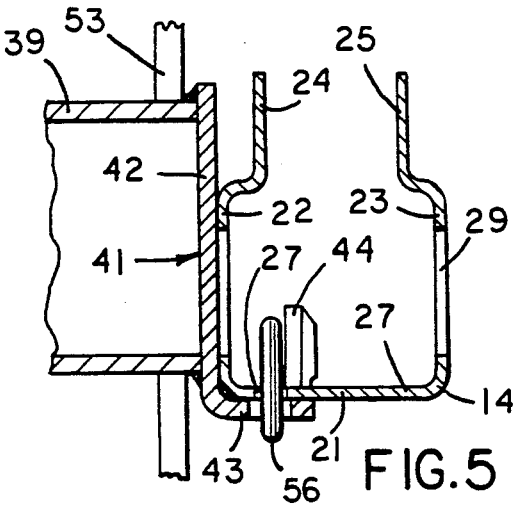
FIG. 5 is a sectional view taken substantially along the line 5—5 in FIG. 3.

Referring to FIGS. 3, 4 and 5, the post 14 is of substantially channel-shaped cross-sectional structure (FIG. 5) and it has a front wall 21, two substantially parallel side walls 22 and 23 which extend at right angles to the front wall 21, and a pair of parallel, rearwardly extending flanges 24 and 25 which are integral with the side walls 22 and 23, respectively. Two vertical rows of vertically elongated slots 26 are provided in the front wall 21 of the post 14. The slots 26 are inclined at a small angle inwardly toward the vertical centerline of the front wall 21 in the downward direction. In the illustrated embodiment, the slots 26 in the two vertical rows are substantially horizontally aligned with each other.

Pairs of circular openings 27 are provided in the front wall 21 close to and above the upper ends of each of the slots 26. The openings 27 are adapted to receive a wire safety lock, as will be described later hereinbelow.

The side walls 22 and 23 each have a row of vertically spaced-apart, horizontally elongated slots 29 therethrough. These slots 29 are not functional parts of the instant invention. They are customarily provided in the posts 14 and 15 so that the posts can be used in a variety of different structural arrangements. Also, the flanges 24 and 25 have rows of vertical spaced-apart holes 30 provided therein. The holes 30 also are not functional parts of the instant invention and they are provided so that the posts can be used in other structural arrangements.

The shelves 11 are substantially planar sheets 36 having up-turned side wall portions 37 and an up-turned front wall portion 38. A pair of elongated, horizontal supports 39 are positioned under each shelf 11 toward the front edge and toward the rear edge thereof, respectively. The supports 39 extend between and longitudinally aligned with the posts 14, 14 and posts 15, 15, respectively. In the illustrated embodiment, the support 39 is a tube of circular cross-section. The front shelf support 39 extends between the posts 14, 14 and the rear shelf support 39 extends between the posts 15, 15, of the post assemblies 12 and 13. The shelf 11 rests on the two supports 39 but it is not fixedly connected thereto; rather, the shelf 11 is movable back and forth to a limited extent relative to the supports 39, 39 and can also be pivoted with respect to them to a limited extent as will be discussed hereinbelow.

A support bracket 41 is secured, for example, by welding, to both ends of each of the supports 39 so that the longitudinal ends of each support 39 can be mounted on its associated posts, such as the post 14 as illustrated in FIGS. 3 and 5. Referring to FIG. 5, the support bracket 41 has a base wall 42 which extends parallel with and is adapted to bear against the side wall 22 of the post 14. The support bracket 41 also has a front flange 43 which extends parallel with and is adapted to bear against the front wall 21 of the post 14. A pair of vertically spaced-apart, hook-shaped tongues 44 extend from the flange 43 through adjacent slots 26 in the post 14 so that the support bracket 41 is removably supported on and by the post 14. The hook-shaped tongues 44 are inclined with respect to the vertical in the same manner as the slots 26 so that the hook-shaped tongues 44 can be received in the upper ends of the slots 26 and then slid downwardly therein so that they become releasably wedged in place. The supports 39 can be adjusted vertically upwardly and downwardly by changing the pair of slots 26 in which the hook-shaped tongues 44 are received.

A hole 46 is provided through the flange 43 at a location between the hook-shaped tongues 44. The hole 46 is alignable with the opening 27 in the front wall 21 of the post 14 when the hook-shaped tongues are wedged in place at the bottoms of the slots 26, as illustrated in FIGS. 3 and 4.

Figure 2:
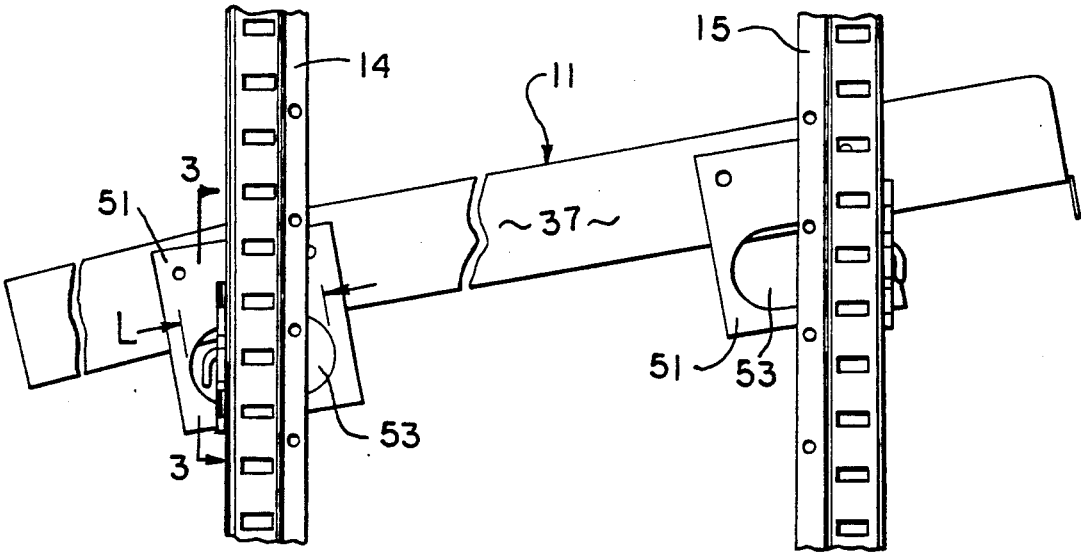
FIG. 2 is a side elevational view, on an enlarged scale, of the flow rack.

Shelf connector plates 51 are mounted at opposite axial ends of each of the supports 39. Each plate 51 is disposed between the adjacent up-turned edge portion 37 of its associated shelf 11 and the adjacent support bracket 41. The shelf connector plate 51 is fixedly secured to the adjacent up-turned edge portion 37 of the shelf 11 by screws 52. The shelf connector plate 51 has a substantially horizontal, elongated opening 53 therein. The support 39 extends through the opening 53. The horizontal length L (FIG. 2) of the opening 53 in the shelf connector plate 51 is substantially greater than, preferably is at least about twice as large as, the diameter of the support 39. Moreover, the width W (FIG. 3) of the opening 53 is larger than the diameter of the support 39 so as to leave a vertical clearance 54 therebetween (FIG. 3). Thus, the shelf connector plate 51 is free to move, in the lengthwise direction of the opening 53, relative to the support 39 so that the angle of inclination of the shelf 11, relative to the vertical, can be changed.

A manually removable wire lock 56 is receivable through the aligned openings 27 and 46 in order to releasably lock the bracket 41, and thereby the support 39 and shelf 11, against unintentional separation from the post 14. As shown in FIG. 4, the wire lock 56 has a relatively short front leg 57, a reversely bent portion 58, an intermediate leg portion 59 and a rear leg 60. In the mounted position of the lock 56, the front leg 57 extends parallel with wall 21 and flange 43. The reversely bent portion 58 extends through the hole 46 and opening 27. The intermediate leg portion 59 diverges in a downward direction relative to the wall 21 and the rear leg 60 converges in a downward direction relative to the wall 21 and extends to a position spaced a small distance from the inner side of the wall 21. When the wire lock 56 is in a vertical position, as shown in solid lines in FIG. 3, it cannot be removed because there is an interference between the front leg 57 and front surface of the flange 43. But when the wire lock 56 is pivoted to the lateral position shown in broken lines in FIG. 3, the wire lock 53 can be gripped at a location close to the juncture of front leg 57 with the reversely curved portion 58 and pulled away from post 14 which will result in the reminder of the wire lock mechanism moving outwardly from the openings 27, 46. In this manner, the lock 56 is intentionally removable so that the shelf 11 and associated parts can be separated from the post 14.

In use, the vertical position of each shelf 11 can be initially determined by inserting the hook-shaped tongues 44 of the respective support brackets 41 into the appropriate slots 26 in the posts 14 and 15 in the usual manner.

In order to change the angle of inclination of a shelf 11 with respect to the vertical, or to change the vertical position of the entire shelf 11 as a whole, the two wire locks 56 are removed from the front two or the rear two supports brackets and posts. For purposes of the following description, it will be assumed that the wire locks 56 are removed from the front two support brackets 41 and posts 14, 14. Then, the two front support brackets 41 are removed from their associated front posts 14, 14. At this time, the rear two support brackets 41 and posts 15 remain connected together. Because of the shapes and sizes of the openings 53 in the rear two support brackets 41, the front end of the shelf 11 can be moved up or down by substantially a hinging motion. It is to be noted, however, that the two rear shelf connector plates 51 and the shelf 11 can pivot and can move forwardly or backwardly relative to their associated support posts 39, to a limited extent. Thus, the front end of the shelf 11 can be moved upwardly or downwardly to provide the desired inclination of the shelf 11. The geometry of the slots 53 relative to the supports 39 makes it possible to change the vertical position of the free end of the shelf 11, but because of the shapes of the slots 53, movement of the free end of the shelf is limited and restricted.

After the free end of the shelf 1 is properly positioned, then the support brackets 41 at the free end of the shelf are inserted into the appropriate slots 26 in the posts, following which the locks 56 are reinserted. If only the angle of inclination of the shelf is being changed, this will complete the adjustment.

If the vertical position of the entire shelf is to be changed, then after reengaging the support brackets 41 and locks 56 at one end of the shelf, the above described steps can be repeated at the other end of the shelf in order to adjust its entire vertical position.

It is to be noted that the removal and insertion of the locks 56 and the steps for changing the vertical position and/or angle of inclination of the shelf 11 can be performed without the use of tools and, thus, such adjustments can be readily performed by assembly operators.

Figure 6:
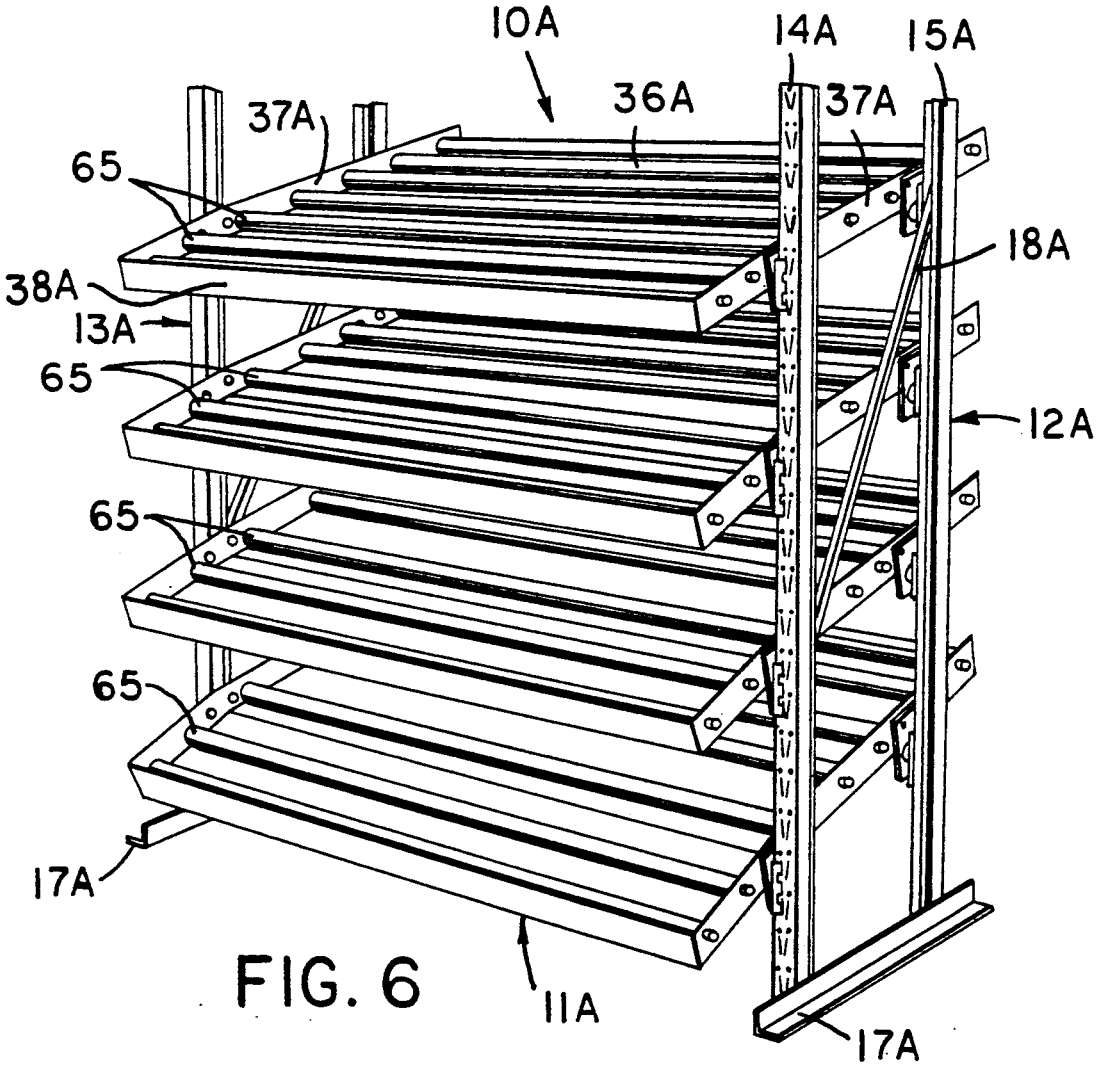
FIG. 6 is a view like FIG. 1 and showing a modification of the invention.

FIG. 6 illustrates a modification in which the shelves are provided with rollers 65 so that objects placed thereon will roll toward the lower edge thereof. Other parts illustrated in FIG. 6 are identified by the same reference numbers with the suffix "A" added.

Although a particular preferred embodiment of the invention has been described, the invention contemplates such changes or modifications therein as lie within the scope of the appended claims.

The embodiments of the invention in which an exclusive property or privilege is claimed are defined as follows:

1. A flow rack comprising: a plurality of elongated, substantially horizontal shelves, a pair of upright post assemblies for supporting said shelves; a pair of support structures associated with each shelf, said support structures being laterally spaced from each other and being located close to the back and close to the front of said shelf, respectively, each of said support structures comprising a support post extending lengthwise of said shelf between said post assemblies and means on said support post for releasably fixedly securing said support post to said upright post assemblies; support members fixedly secured to said shelf close to the ends thereof, said support members having elongated openings therethrough which are elongated in a direction extending from the rear to the front of said shelf, said support posts extending through said openings so that said shelf can move frontwardly and backwardly and can pivot with respect to said support posts.

2. A flow rack as claimed in claim 1 wherein said means for releasably fixedly securing said support post to said upright post assemblies comprises support brackets at each end of said support post and including a lock for releasably securing each of said support brackets to its associated post assembly.

3. A flow rack as claimed in claim 3 in which each support bracket and its associated post assembly has openings which are in alignment and said lock is a wire lock element extending through said openings, said wire lock element being shaped so that in one position of said wire lock element relative to said support bracket and post, the wire lock element cannot be removed from said openings and when said wire lock element is rotated relative to said support bracket and post to a second position, the wire lock element can be removed from said openings.

4. A flow rack as claimed in claim 2 in which said upright post assemblies each comprise two upright posts, one located close to the backs of the shelves and the other located close to the fronts of the shelves, each support structure being mounted in one of said posts, said posts having at least one vertical row of spaced-apart slots, said support brackets having hooks removably receivable in said slots.

5. A flow rack, comprising:

a pair of upright post assemblies, each post assembly comprising a front post and a rear post, each said post having a wall having a vertical row of substantially vertical slots therethrough;

a plurality of elongated, substantially horizontal shelves located and extending between said post assemblies;

a pair of circular, tubular supports for each of said shelves, said tubular supports respectively extending between said front posts and said rear posts of said post assemblies, a support bracket fixedly secured to each of said tubular supports, said support bracket having a wall adapted to bear against said post wall and having a plurality of hooks extending through said slots so that said support bracket is releasably fixedly mounted on said post;

upright connector plates on each of said tubular supports adjacent to the opposite ends thereof and located on the remote side of said support brackets from said posts, said connector plates being fixedly secured to said shelves, said connector plates each having an elongated through slot which is elongated in a direction extending from the rear to the front of said shelves, said tubular supports extending through said slots and being free of fixed connection to said shelves and said connector plates whereby said shelves can pivot and can move back and forth relative to said tubular support to the extent permitted by said slots.

6. A flow rack comprising: an elongated, substantially horizontal shelf; a pair of upright post assemblies located at opposite longitudinal ends of said shelf and supporting said shelf; a support structure associated with said shelf, said support structure comprising support portions at opposite longitudinal ends of said shelf and extending lengthwise with respect to said shelf toward said post assemblies and means on said support portions for releasably fixedly securing said support structure to said upright post assemblies; support members fixedly secured to said shelf close to the ends thereof, said support members having elongated openings therethrough which are elongated in a direction extending from the rear to the front of said shelf, said support portions extending through said openings so that said shelf can move frontwardly and backwardly and can pivot with respect to said support structure.

* * * * *